US011684923B2

(12) United States Patent
Chien et al.

(10) Patent No.: US 11,684,923 B2
(45) Date of Patent: Jun. 27, 2023

(54) MODULAR REAGENT PLATE AND REAGENT VESSEL KIT

(71) Applicant: Taiwan Advanced Nanotech Inc., Taoyuan (TW)

(72) Inventors: Chien-Hsing Chien, Taoyuan (TW); Kun-Hang Jao, Taoyuan (TW)

(73) Assignee: Taiwan Advanced Nanotech Inc., Taoyuan (TW)

( * ) Notice: Subject to any disclaimer, the term of this patent is extended or adjusted under 35 U.S.C. 154(b) by 368 days.

(21) Appl. No.: 16/436,360

(22) Filed: Jun. 10, 2019

(65) Prior Publication Data

US 2020/0238289 A1 Jul. 30, 2020

(30) Foreign Application Priority Data

Jan. 30, 2019 (TW) ..... 108103614

(51) Int. Cl.
*B01L 9/06* (2006.01)
*B01L 3/00* (2006.01)
*B01L 9/00* (2006.01)

(52) U.S. Cl.
CPC ..... *B01L 3/527* (2013.01); *B01L 9/00* (2013.01); *B01L 2200/028* (2013.01); *B01L 2200/16* (2013.01)

(58) Field of Classification Search
CPC combination set(s) only.
See application file for complete search history.

(56) References Cited

U.S. PATENT DOCUMENTS 4,895,706 A * 1/1990 Root ..... B01D 61/18 422/534
8,911,691 B2 * 12/2014 Giraud ..... B01L 9/06 422/561
2013/0272931 A1 * 10/2013 Chien ..... B01L 3/5085 422/547

* cited by examiner

*Primary Examiner* — Paul S Hyun
(74) *Attorney, Agent, or Firm* — Birch, Stewart, Kolasch & Birch, LLP

(57) ABSTRACT

The present invention provides a modular reagent plate, comprising: a support rack comprising a frame and one or more separators, wherein two ends of each separator are respectively connected to the frame; and a base comprising a frame body, wherein the support rack is disposed on the frame body of the base and can be detachably combined with the base. A reagent vessel kit is also provided by assembling a reagent vessel to the above-described modular reagent plate. Unnecessary waste of reagent vessels can be avoided according to the present invention.

9 Claims, 9 Drawing Sheets

MODULAR REAGENT PLATE AND REAGENT VESSEL KIT

BACKGROUND

Technical Field

The present invention relates to a reagent plate and a reagent vessel kit. More particularly, the present invention provides a modular reagent plate in which reagent vessels can be arranged in different numbers and forms, so that users can assemble and obtain a reagent vessel kit in a flexible manner depending on their needs.

Description of Related Art

Reagent vessels used in biology experiments may vary in terms of, for example, the size of the vessel body or the number of slots contained therein, depending on the types of experiments. FIG. 1 shows a commercially available 24-well plate 3 comprising a reagent vessel 31 and a base 32, wherein the reagent vessel 31 and the base 32 are inseparable and formed as one piece. The reagent vessel has a total of 24 slots 33 arranged in six rows and four columns. The number of slots is set at 24 and cannot be changed. As such, all unused slots in an experiment cannot be separated from used ones and have to be discarded therewith even if less than 24 slots have been used. Furthermore, given that the base and the reagent vessel are formed as one piece, the base must be discarded along with the reagent vessel even if it has not been used for containing the reagent and should therefore remain uncontaminated. Nor is the base reusable, thus resulting in a waste of consumables and an increase in cost.

FIG. 2 shows a commercially available 96-well plate 4 comprising multiple reagent vessels 41 and a base 42. The base 42, which comprises a frame 421, is formed as one piece with a latticed separator 422. The separator 422 divides the space defined by the frame 421 of the base 42 into 96 wells, each well corresponding to one slot of a reagent vessel 41. Each reagent vessel 41 comprises eight slots, which are arranged in one row and formed as one piece. A maximum of 12 reagent vessels may be disposed on the base 42, giving a total of 96 slots. However, the number of the slots depends on the number of the reagent vessels; that is, the assembled slots can only be in a multiple of 8 instead of other numbers. In addition, since the base 42 is formed as one piece with the frame 421 and the separator 422, no other types of separator 422 can be used to fit various types of reagent vessels. This commercially available 96-well plate comprises a base that can be detached from the reagent vessel, and thus, it is possible to discard the reagent vessels only and reuse the base to reduce the waste of consumables; nevertheless, unused slots should still be discarded together with used ones. In view of the above, there is a need for developing a modular reagent plate and reagent vessel kit that can be used in a more flexible manner and can reduce the waste of consumables.

SUMMARY OF THE INVENTION

The present invention provides a modular reagent plate and reagent vessel kit. By using different forms of separators within a support rack, the present invention allows reagent vessels accommodated in the base to come in various numbers depending on experimental needs, so that users can adjust the number of reagent vessels and slots more easily and flexibly. The waste of reagent vessels can be effectively reduced, as unused reagent vessels do not have to be discarded together with the used ones over contamination concerns. In addition, by allowing users to reuse reagent plates and replace the reagent vessels disposed thereon, the present invention can be advantageous in achieving the goals of reducing experimental consumables, lowering costs and providing more eco-friendly options.

In accordance with an embodiment disclosed herein, the present invention provides a modular reagent plate, comprising:

a support rack comprising a frame and one or more separators, wherein two ends of each separator are respectively connected to the frame; and a base comprising a frame body, wherein the support rack is disposed on the frame body of the base and can be detachably combined with the base.

In a preferred embodiment, the support rack further comprises a first fastener positioned on at least one edge of the frame, the frame body of the base further comprises a second fastener positioned on at least one side wall of the frame body, and the first fastener and the second fastener correspond to each other and can be joined together.

In a preferred embodiment, the first fastener includes a projecting portion, a screw or a bump, and the second fastener includes a recess portion, a tapped hole or a receiving portion.

In a preferred embodiment, the separators can be arranged horizontally and/or vertically.

In a preferred embodiment, the separators are used to partition an accommodating space within the frame into a plurality of spaces.

In a preferred embodiment, the support rack is used to accommodate one or more reagent vessels.

In a preferred embodiment, the modular reagent plate further comprises a heat plate.

In accordance with an embodiment disclosed herein, the present invention further provides a reagent vessel kit, comprising:

a reagent vessel comprising a plurality of slots formed as one piece; and a base comprising a frame body, wherein the reagent vessel is disposed on the frame body of the base and can be detachably combined with the base.

In a preferred embodiment, the reagent vessel further comprises a first fastener positioned on at least one side surface thereof, the frame body of the base further comprises a second fastener positioned on at least one side wall of the frame body, and the first fastener and the second fastener correspond to each other and can be joined together.

In a preferred embodiment, the first fastener includes a projecting portion, a screw or a bump, and the second fastener includes a recess portion, a tapped hole or a receiving portion.

In a preferred embodiment, the reagent vessel has 24 slots.

In accordance with an embodiment disclosed herein, the present invention further provides a reagent vessel kit, comprising:

a reagent vessel comprising a plurality of slots formed as one piece; and any modular reagent plate described in the above paragraphs, wherein the reagent vessel is disposed on a space defined by the separators of the support rack.

In a preferred embodiment, the reagent vessel further comprises a third fastener positioned on at least one side surface thereof, the support rack further comprises a fourth fastener positioned on the frame and/or the separator of the support rack, and the third fastener and the fourth fastener correspond to each other and can be joined together.

In a preferred embodiment, the third fastener includes a protruding portion, and the fourth fastener includes a groove portion.

In a preferred embodiment, the reagent vessel kit further comprises a heat plate to heat the reagent vessel.

In a preferred embodiment, the plurality of slots include 2, 3, 4, 6, 8 or 12 slots.

Using the modular reagent plate and reagent vessel kit disclosed herein can create various forms of the support rack on the base to accommodate reagent vessels in the number as desired. This allows users who carry out experiments to use reagent vessels with more ease, as various numbers and arrangements of reagent vessels can be obtained more flexibly in accordance with experimental needs. In addition, since the number of reagent vessels can be adjusted depending on actual needs, the waste of experimental consumables, which often results from discarding unused reagent vessels due to their fixed formats, can be effectively reduced. Also, as the reagent plate can be reused, users will only need to replace reagent vessels for another experiment, which can help further reduce the waste of laboratory tools.

DETAILED DESCRIPTION OF THE PREFERRED EMBODIMENTS

The term "detachable" used herein means that two components can be either separated or joined depending on specific needs. The term "corresponding to" used herein means that two components can be joined and fastened to each other when arranged in a specific direction.

Provided below are various embodiments of the present invention that illustrate the technical features and advantages thereof. However, the embodiments are not intended to limit the present invention. Without departing from the concept of the present invention, a person having ordinary skill in the art could make changes or adjustments to the structural features of the reagent plate or reagent vessel kit disclosed herein in accordance with the requirements of experiment apparatus.

Figure 1:
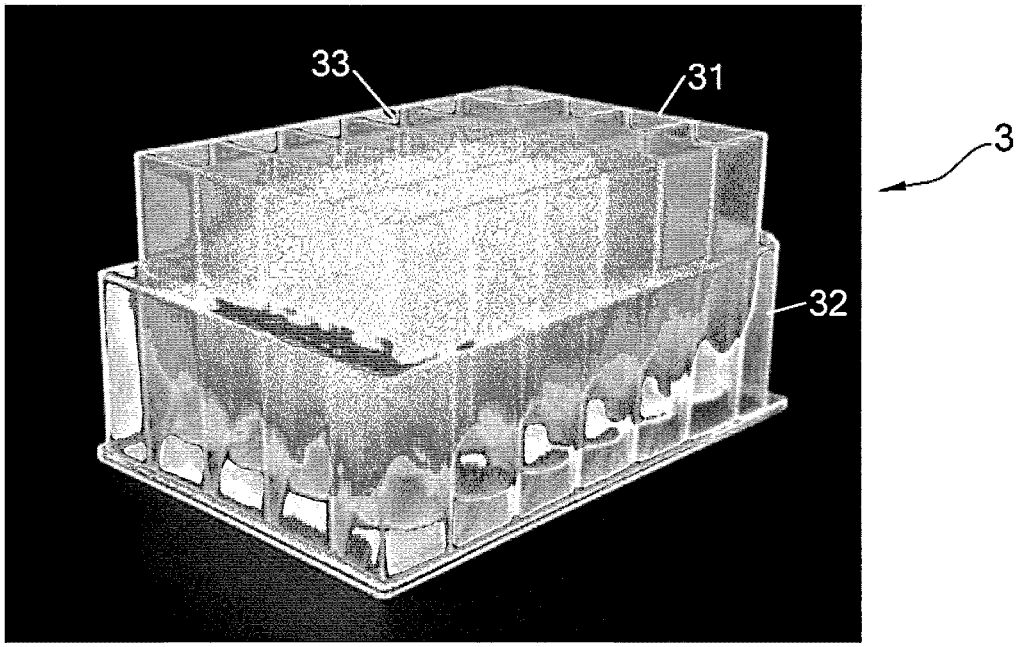
Fig. 1 (PRIOR ART)
FIG. 1 shows a prior art 24-well plate.
Figure 2:
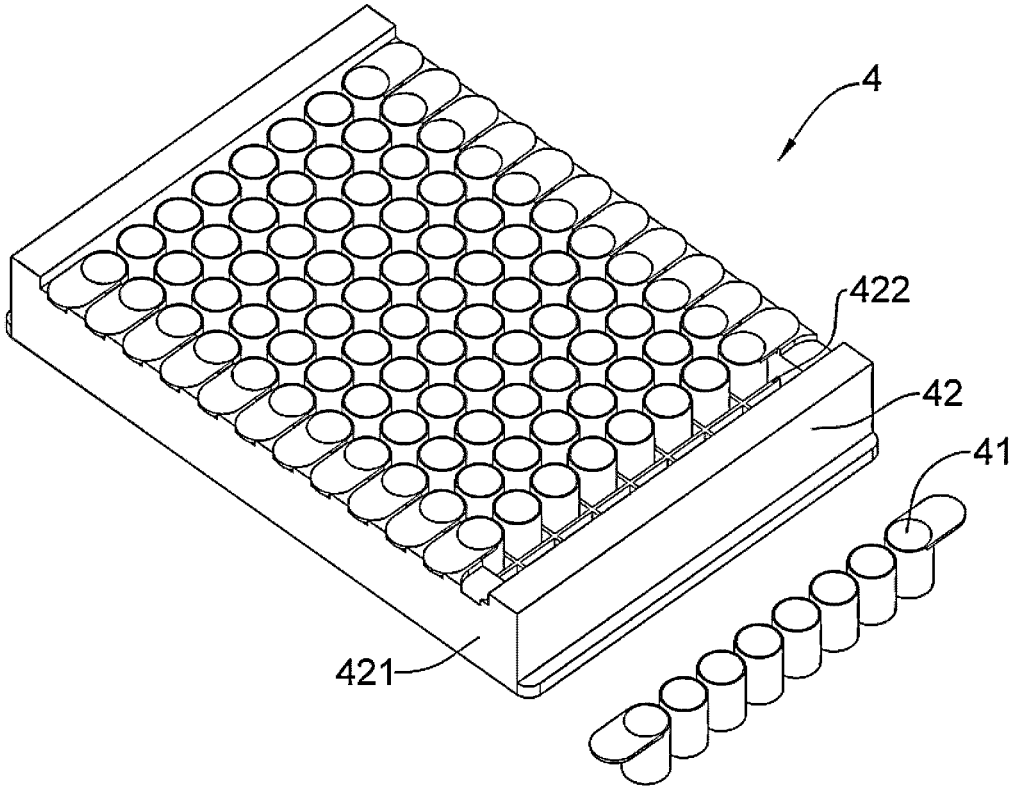
Fig. 2 (PRIOR ART)
FIG. 2 shows a prior art 96-well plate.
Figure 3:
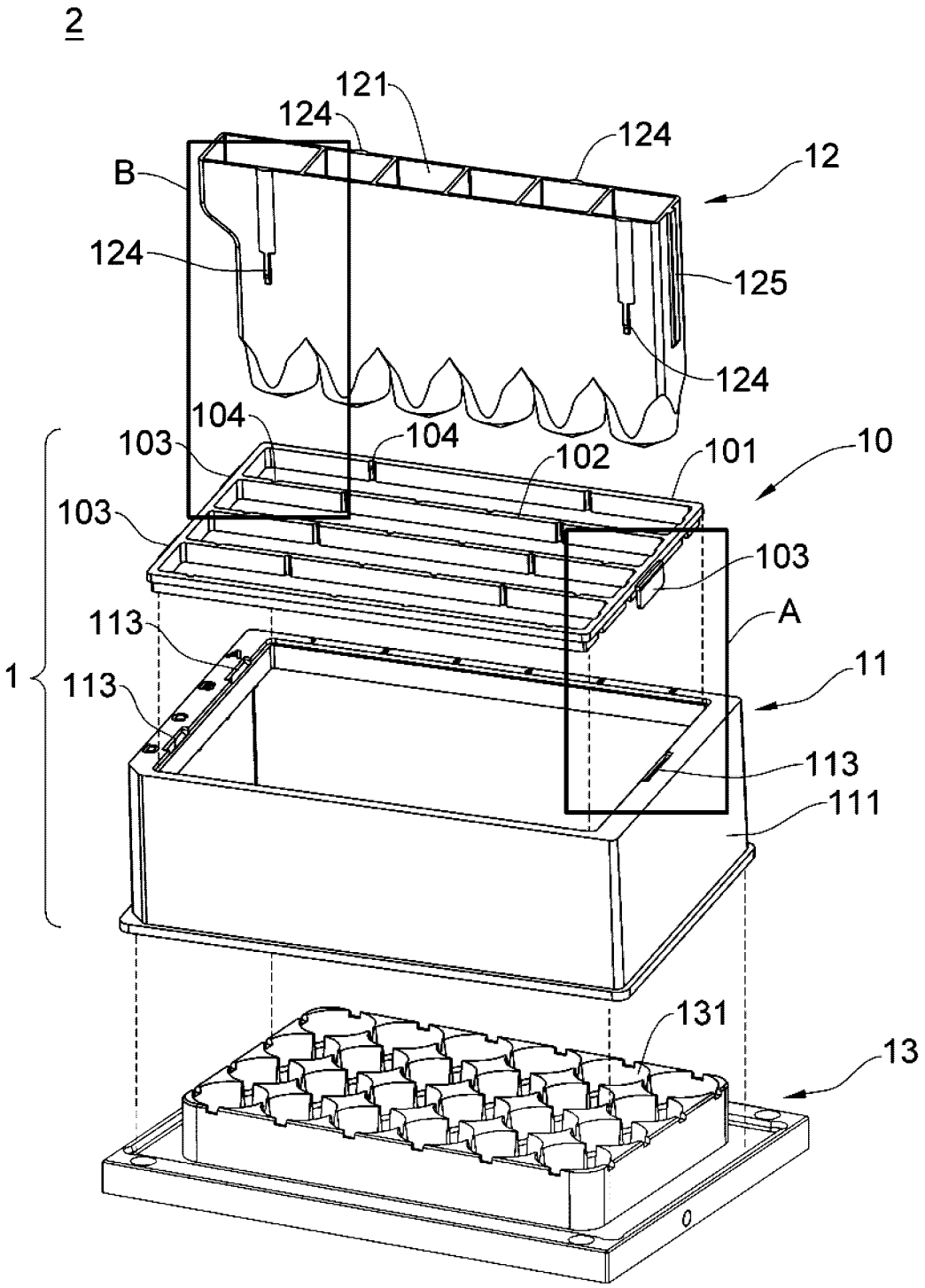
FIG. 3 is an exploded view showing the components of the reagent vessel kit according to the first embodiment disclosed herein.

FIG. 3 is an exploded view showing the components of a reagent vessel kit 2 (taking a 6-slot reagent vessel as an example) according to the first embodiment disclosed herein. As shown in FIG. 3, the reagent vessel kit comprises: a reagent vessel 12, a reagent plate 1 and a heat plate 13, wherein the reagent plate 1 comprises a support rack 10 and a base 11. The reagent plate 1 is assembled by inserting the support rack 10 into the base 11. The reagent vessel kit 2 is assembled by inserting the bottom of the reagent vessel 12 into the support rack 10 of the reagent plate 1, with the opening of the reagent vessel 12 facing upwards. The reagent vessel 12 is used for containing various reagents/samples required in an experiment. When assembling the components of the reagent vessel kit 2, no specific sequences must be followed. In addition to the sequence described in the above example, it is also possible to first join the reagent vessel 12 to the support rack 10, and then join the support rack 10 to the base 11, depending on usage habits.

During an experiment, if the substances contained in the reagent vessel 12 requires heat, place the assembled reagent vessel 12 and reagent plate 1 onto the heat plate 13 to heat the reagent vessel 12. After heating, remove the assembled reagent vessel 12 and reagent plate 1 from the heat plate 13 to carry out further steps. At the end of the experiment, detach the reagent vessel 12 from the reagent plate 1 and discard the reagent vessel 12 that has been used, while the reagent plate 1 can be kept for reuse.

Provided below is a detailed description of the structure of each component in the reagent vessel kit 2 according to the first embodiment. As shown in FIG. 3, in one example of the present invention, the support rack 10 of the reagent plate 1 has a frame 101 and at least one separator 102. In a preferred embodiment, the frame 101 is rectangular. Two ends of each separator 102 are both connected to the frame 101. The space within the frame 101 may be partitioned in row and/or in column arrangements to accommodate the reagent vessel 12 with different slot patterns. In the row arrangement, for example, the separator 102 lies parallel to the longer side of the frame 101, partitioning the space within the frame 101 into a plurality of strips. In a preferred embodiment, the support rack 10 has three separators 102 that partition the area defined by the frame 101 into four strips, each strip being used for accommodating a 6-slot reagent vessel 12. One or more reagent vessels 12 may be placed on the support rack to be used in conjunction with each other in a flexible manner. The separator 102 of the support rack 10 disclosed herein may come in any number. The number thereof may be adjusted based on actual needs for the purpose of partitioning the space into appropriate areas that accommodate the reagent vessels.

In one example of the present invention, the base 11 of the reagent plate 1 has a frame body 111 that is used for accommodating the reagent vessel 12 and the support rack 10. No specific sizes or shapes are required for the base, provided that the above effects can be achieved. In a preferred embodiment, the frame body 111 of the base 11 is a hollow, rectangular cuboid that closely matches the shape of the frame 101 of the support rack 10, so that the support rack 10 can be accommodated therein.

In one example of the present invention, the reagent vessel 12 has more than one slot 121 and can be, for example, a 2-slot, 3-slot (see FIG. 9), 4-slot, 6-slot (see FIG. 3), 8-slot, or 12-slot (see FIG. 4) reagent vessel. The reagent vessel 12 corresponds to a partitioned area created by separators 102 of the support rack 10 and can be inserted into said area to be fastened thereto. No specific sizes or shapes for the reagent vessel 12 nor specific numbers of the slots 121 are required, provided that the above effects are achieved. In a preferred embodiment, the reagent vessel 12 has six slots 121 that are formed as one piece and can be inserted into a partitioned area created by the separators 102. In a preferred embodiment, the support rack 10 has three separators 102 creating four strips arranged row by row. The reagent vessel 12 having six slots 121 may be inserted into any of the strips depending on the needs of the experiment. Alternatively, two 6-slot reagent vessels 12 may be inserted into two respective strips within the support rack 10. In one example of the present invention, the bottom portions of the slots 121 correspond to slots 131 of the heat plate 13, allowing the bottom portions of the reagent vessel 12 to be placed into the corresponding slots 131 of the heat plate 13 to be heated. No specific sizes or shapes for the bottom portions and openings of the slots 121 are required, provided that the above effects are achieved. In a preferred embodiment, the bottom portions of the slots 121 are flat and substantially circular, and the openings thereof are substantially quadrilateral.

In one example of the present invention, the heat plate 13 has slots 131 that correspond to the bottom portions of the slots 121 of the reagent vessel 12, allowing the bottom portions of the slots 121 to be placed into the slots 131 of the heat plate 13 to be heated. No specific sizes or shapes for the slots 131 are required, provided that the above effects are achieved. In a preferred embodiment, the slots 131 are substantially circular cylinders.

Figure 4:
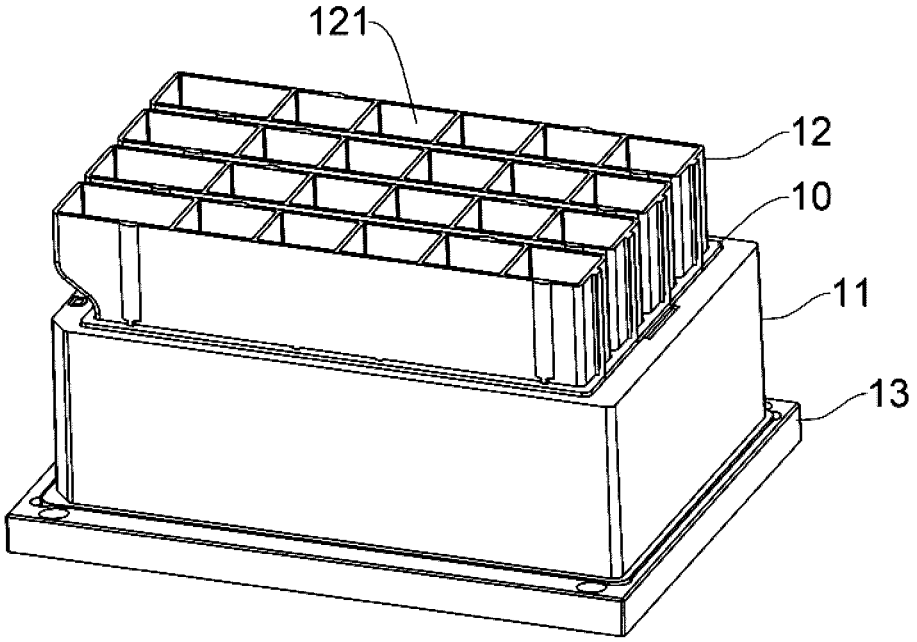
FIG. 4 shows an assembled view of the reagent plate kit without the heat plate according to the first embodiment disclosed herein.

FIG. 4 is an assembled view of the reagent vessel kit 2 according to the first embodiment. As shown in FIG. 4, the lower half of the slots 121 of the reagent vessel 12 is inserted into the assembled reagent plate 1, while the upper half of the slots 121 is disposed above the assembled reagent plate 1. The number of the reagent vessels 12 inserted into the reagent plate 1 may be adjusted according to the needs of an experiment. In a preferred embodiment, the support rack 10 has three separators 102 partitioning the area defined by the frame 101 into 4 strips, and is joined to the base 11 to form a reagent plate. Up to four 6-slot reagent vessels 12 may be inserted into the assembled reagent plate 1.

Figure 5:
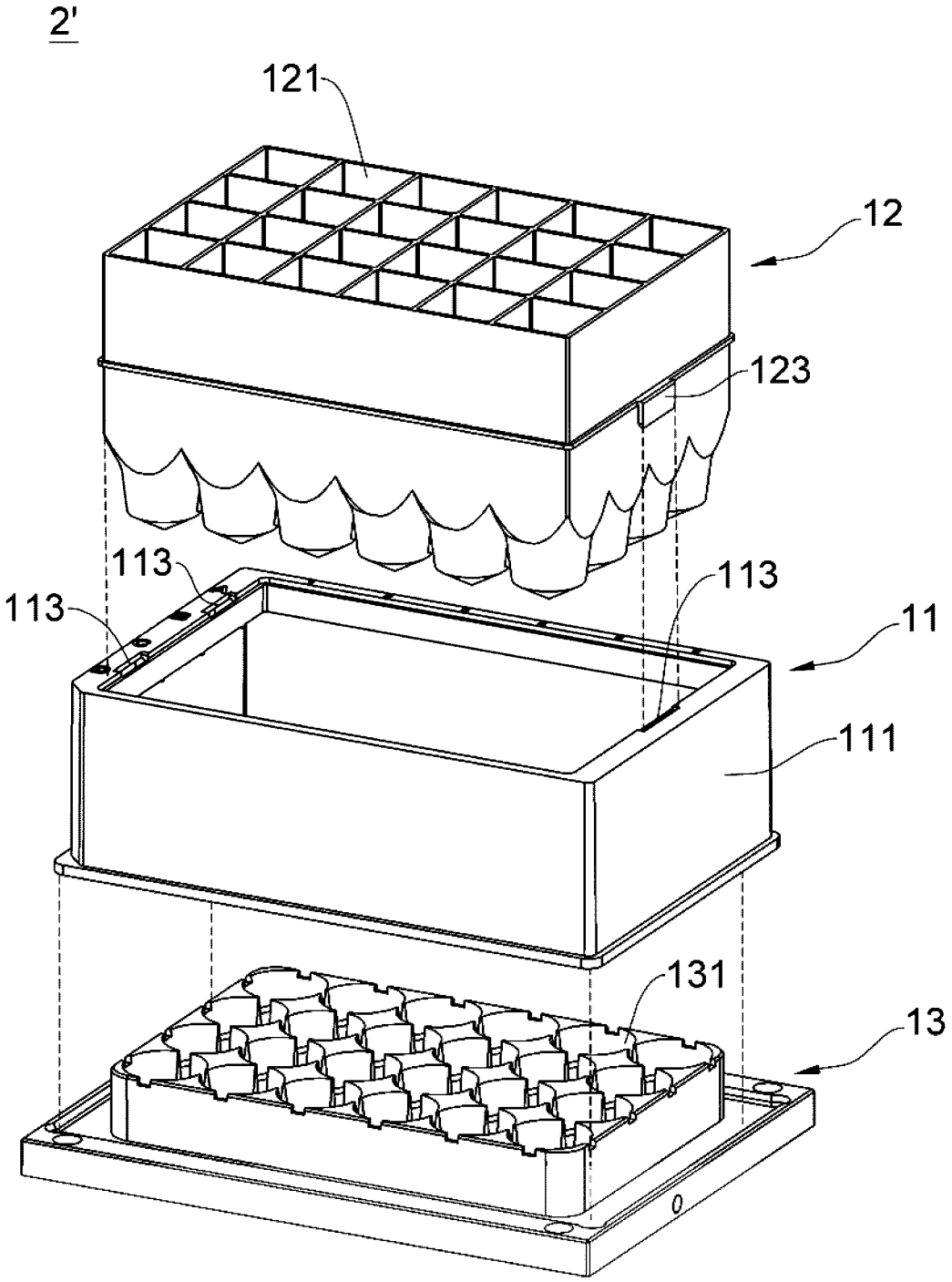
FIG. 5 shows an exploded view of the reagent vessel kit according to the second embodiment disclosed herein.

FIG. 5 is an exploded view showing the components of a reagent vessel kit 2' (taking a 24-slot reagent vessel as an example) according to the second embodiment of the present invention. As shown in FIG. 5, the reagent vessel kit 2' comprises: a reagent vessel 12, a base 11 and a heat plate 13. The reagent vessel kit 2' is assembled by inserting the bottom of the reagent vessel 12 into the frame body 111 of the base 11, with the opening of the reagent vessel 12 facing upwards. In this embodiment, the reagent vessel kit 2' does not need a support rack 10 to accommodate the reagent vessel 12; the reagent vessel 12 with a plurality of slots can be directly accommodated in the base 11.

During an experiment, if the substances contained in the reagent vessel 12 requires heat, place the joined reagent vessel 12 and base 11 onto the heat plate 13 to heat the reagent vessel 12. After heating, remove the joined reagent vessel 12 and base 11 from the heat plate 13 to carry out further steps. At the end of the experiment, detach the reagent vessel 12 from the base 11 and discard the reagent vessel 12 that has been used, while the base 11 can be kept for reuse. Provided below is a detailed description of the structure of each component in the reagent vessel kit 2' according to the second embodiment. As shown in FIG. 5, in one example of the present invention, the base 11 has a frame body 111 that is used for accommodating the reagent vessel 12. No specific sizes or shapes for the base are required, provided that the above effects can be achieved. In a preferred embodiment, the base 11 is the same as that in the first embodiment.

In one example of the present invention, the reagent vessel 12 has 24 slots 121 that are formed as one piece (as shown in FIG. 5). The reagent vessel 12 corresponds to the frame body 111 of the base 11 and can be inserted therein to be fastened thereto. No specific sizes or shapes for the reagent vessel 12 are required, provided that the above effects are achieved. In one example of the present invention, the bottom portions of the slots 121 correspond to the slots 131 of the heat plate 13, allowing the bottom portions of the slots 121 to be placed into the corresponding slots 131 of the heat plate 13 to be heated. No specific sizes or shapes for the bottom portions and openings of the slots 121 are required, provided that the above effects are achieved. In a preferred embodiment, the bottom portions of the slots 121 are flat and substantially circular, and the openings thereof are substantially quadrilateral.

In one example of the present invention, the heat plate 13 has slots 131 that correspond to the bottom portions of the slots 121 of the reagent vessel 12, allowing the bottom portions of the slots 121 to be placed into the corresponding slots 131 of the heat plate 13 to be heated. In a preferred embodiment, the heat plate 13 is the same as that in the first embodiment.

Figure 6:
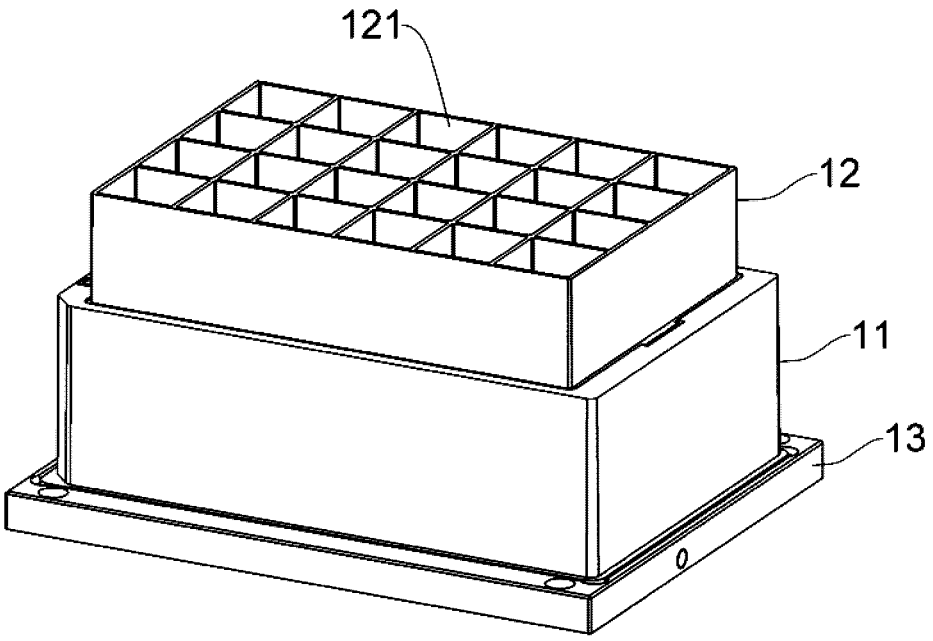
FIG. 6 shows an assembled view of the reagent plate kit according to the second embodiment disclosed herein.

FIG. 6 is an assembled view of the reagent vessel kit 2' according to the second embodiment. As shown in FIG. 6, the lower half of the 24 slots 121 (formed as one piece) of the reagent vessel 12 is inserted into the base 11, while the upper half of the slots 121 is disposed above the base 11. No specific proportion is required between the upper and lower halves of the reagent vessel 12 placed into the base 11, provided that the reagent vessel 12 and the base 11 are joined stably, that the reagent vessel 12 can be taken out and inserted easily, and that the bottom of the reagent vessel 12 can come into contact with the heat plate 13 to be heated.

Figure 7:
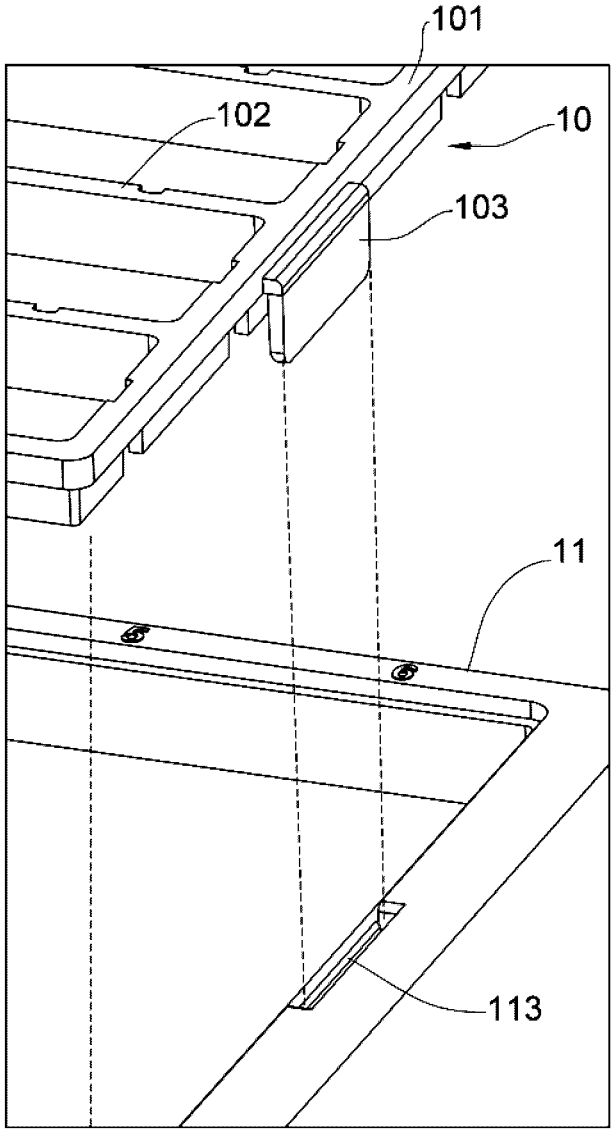
FIG. 7 shows an enlarged view of the fasteners on the support rack and the base according to the first embodiment disclosed herein.

FIG. 7 is an enlarged view of the fasteners on the support rack 10 and the base 11 according to the first embodiment taken from box A in FIG. 3. Please refer to FIGS. 3 and 7, which show that the support rack 10 and the base 11 comprise corresponding and paired fasteners that allow the support rack 10 and the base 11 to be fastened together when joined. Preferably, the support rack 10 further comprises at least one first fastener (such as a projecting portion 103) disposed on at least one edge of the frame 101, and the frame body 111 of the base 11 further comprises at least one second fastener (such as a recess portion 113) disposed on at least one side wall of the frame body, wherein the first and second fasteners correspond to each other and can be joined and fastened together. In a preferred embodiment, the first fastener of the support rack 10 is a projecting portion 103, the second fastener of the base 11 is a recess portion 113, and the projecting portion 103 can be inserted into the recess portion 113 to be fastened together. In a preferred embodiment, the first fastener of the support rack 10 is a screw, the second fastener of the base 11 is a tapped hole, and the screw can be locked into the tapped hole to secure each other. In another preferred embodiment, the first fastener of the support rack 10 is a bump, the second fastener of the base 11 is a receiving portion, and the bump can be secured to the receiving portion by a hook when inserted in the receiving portion. The hook can be selected from a spring hook and a slide hook with bumps. In a preferred embodiment, the projecting portion 103 is a flat sheet vertically disposed on the frame 101 of the support rack 10; the recess portion 113 of the base 11 is a slot that is disposed on a side wall of the frame body 111 of the base 11 and corresponds to the projecting portion 103 in terms of position. The projecting portion 103 is inserted into the recess portion 113 and fastened thereto when the support rack 10 is joined to the base 11, thereby allowing the support rack 10 and base 11 to be combined and form the reagent plate 1 of the present invention. In a preferred embodiment, three projecting portions 103 are provided, wherein one projecting portion 103 is disposed on one edge of the frame 101 of the support rack 10, while the other two projecting portions 103 are disposed on an opposite edge of the frame 101 of the support rack 10. Also, three recess portions 113 are provided and disposed on the side walls of the frame body 111 of the base 11, corresponding to said projecting portions 103 in terms of position. No specific numbers, shapes or positions are required for said first fastener (such as the projecting portion 103) and second fastener (such as the recess portion 113), provided that the support rack 10 and base 11 can be fastened.

Figure 8:
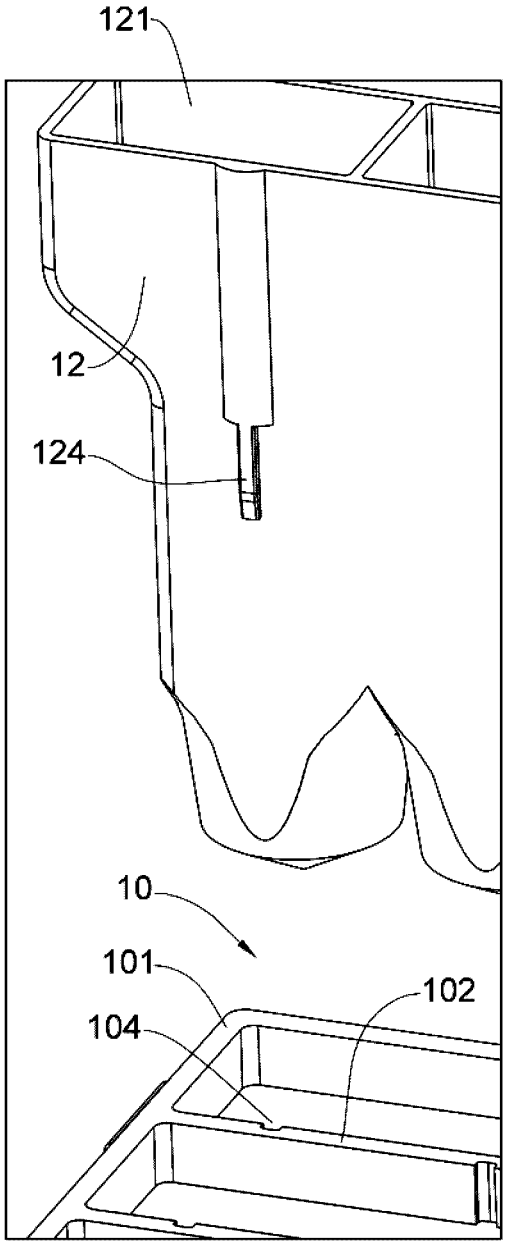
FIG. 8 shows an enlarged view of the fasteners on the reagent vessel and the support rack according to the first embodiment disclosed herein.

FIG. 8 is an enlarged view of the fasteners on the reagent vessel 12 and the support rack 10 according to the first embodiment taken from box B in FIG. 3. Please refer to FIGS. 3 and 8, which show that the reagent vessel 12 and the support rack 10 comprise corresponding and paired fasteners that allow the support rack 10 and reagent vessel 12 to be fastened together when joined. Preferably, the reagent vessel further comprises a third fastener (such as a protruding portion 124) disposed on at least one side wall of the reagent vessel 12, and the support rack 10 further comprises a fourth fastener (such as a groove portion 104) disposed on the frame 101 and/or the separator(s) 102 of the support rack 10, wherein the third and fourth fasteners correspond to each other and can be joined. In one example of the present invention, the third fastener of the reagent vessel 12 may be a protruding portion 124 or 125, the fourth fastener of the support rack 10 may be a groove portion 104, and the protruding portion 124 or 125 can be inserted into the groove portion 104 to be fastened together. In a preferred embodiment, the protruding portion 124 or 125 is a raised semi-cylinder formed on one side surface of the reagent vessel 12. The groove portion 104 of the support rack 10 is a slot formed on the frame 101 and/or the separator 102 of the support rack 10, corresponding to each protruding portion 124 or 125 in terms of position. The protruding portions 124 and 125 of the reagent vessel 12 are inserted into the groove portions 104 of the support rack 10 and fastened together when the support rack 10 is joined to the reagent vessel 12, thereby enabling the reagent vessel 12 and support rack 10 to form an assembly. The following description uses the 6-slot reagent vessel 12 shown in FIG. 3 as an example. In a preferred embodiment, the 6-slot reagent vessel 12 (slots are designated as the first to sixth slots, from left to right) has four protruding portions 124 and one protruding portion 125, wherein the first and second protruding portions 124 are arranged on one side surface of the reagent vessel 12 at the positions of first and sixth slots 121; the third and fourth protruding portions 124 are arranged on the other side surface of the reagent vessel 12 at the positions of second and fifth slots; the protruding portion 125 is arranged on one side surface of the sixth slot 121; and the side surface with the protruding portion 125 is adjacent to the other two side surfaces with the first, second, third and fourth protruding portions 124. The groove portions 104 are arranged on the frame 101 and/or separator(s) 102 of the support rack 10 and correspond to the protruding portions 124 and 125 in terms of position. No specific numbers, shapes or positions are required for the third fastener on said reagent vessel 12 and the fourth fastener on the support rack 10, provided that the reagent vessel 12 can be fastened to the support rack 10. The arrangement thereof may be adjusted depending on actual needs.

In the second embodiment, both the reagent vessel 12 (with 24 slots) and the base 11 are provided with fasteners. As shown in FIG. 5, the reagent vessel 12 and the base 11 comprise corresponding and paired fasteners that allow the reagent vessel 12 and the base 11 to be fastened together when joined. Preferably, the reagent vessel 12 further comprises at least one first fastener (such as a projecting portion 123) disposed on at least one side surface of the reagent vessel 12, and the frame body 111 of the base 11 further comprises at least one second fastener (such as a recess portion 113) disposed on at least one side wall of the frame body, wherein the first and second fasteners correspond to each other and can be joined and fastened together. In a preferred embodiment, the fastener on the reagent vessel 12 is the projecting portion 123, the fastener on the base 11 is the recess portion 113, and the projecting portion 123 can be inserted into the recess portion 113 to be fastened together. In a preferred embodiment, the projecting portion 123 is a flat sheet vertically disposed on a side surface of the reagent vessel 12; the recess portion 113 of the base 11 is a slot that is disposed on a side wall of the frame body 111 of the base 11 and corresponds to the projecting portion 123 in terms of position. The projecting portion 123 is inserted into the recess portion 113 and fastened thereto when the reagent vessel 12 is joined to the base 11, thereby allowing the reagent vessel 12 and the base 11 to be combined and fastened together. In a preferred embodiment, three projecting portions 123 are provided, wherein one projecting portion 123 is disposed on one side surface of the reagent vessel 12, while the other two projecting portions 123 are disposed on an opposite side surface of the reagent vessel 12. Also, three recess portions 113 are provided and disposed on the side walls of the frame body 111 of the base 11, corresponding to said projecting portions 123 in terms of position. No specific numbers, shapes or positions are required for said first fastener (such as the projecting portion 123) and second fastener (such as the recess portion 113), provided that the reagent vessel 12 and base 11 can be fastened.

Figure 9:
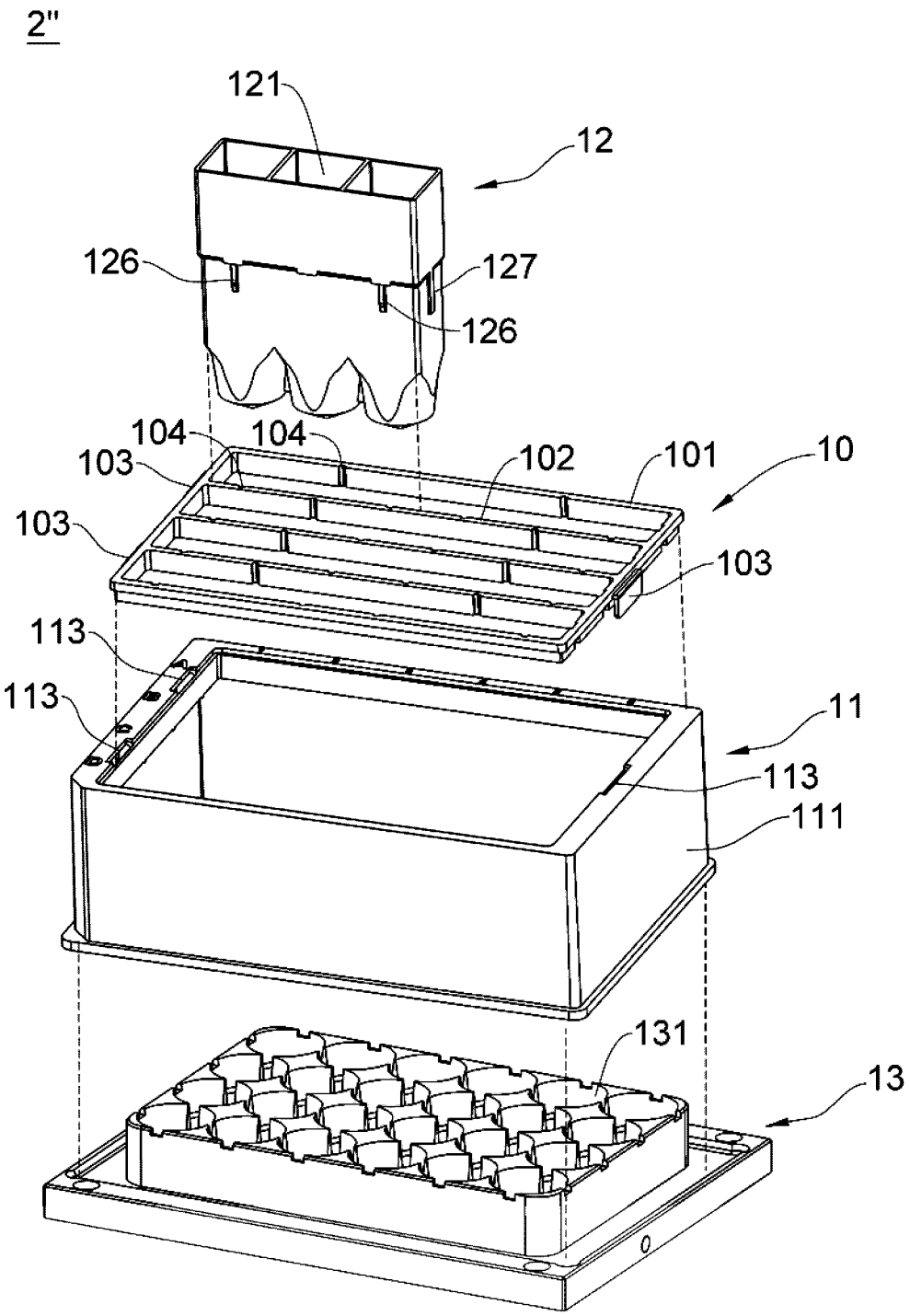
FIG. 9 shows an exploded view of the reagent vessel kit according to the third embodiment disclosed herein.

FIG. 9 is an exploded view showing the components of a reagent vessel kit 2" (the reagent vessel has three slots in this example) according to the third embodiment of the present invention. As shown in FIG. 9, the reagent vessel kit 2" comprises: a reagent vessel 12, s support rack 10, a base 11 and a heat plate 13. In one example of the present invention, the support rack 10, the base 11 and the heat plate 13 according to the third embodiment are identical to those used in the first embodiment. In a preferred embodiment, the reagent vessel 12 with three slots corresponds to a partitioned area created by separators 102 of the support rack 10 and can be inserted into said area to be fastened thereto. In a preferred embodiment, the support rack 10 includes three separators 102 that create four strips arranged row by row. This example illustrates a reagent vessel 12 with three slots 121, and the reagent vessel 12 may be inserted into any of the partitioned areas depending on experimental needs, for example, one that is closer to either the left or the right side. Alternatively, two 3-slot reagent vessels 12 may be used and inserted into different partitioned areas of the support rack 10, or inserted into the same partitioned area of the support rack 10.

In one example of the present invention, the reagent vessel 12 according to the third embodiment uses fasteners that are identical to those described in the first embodiment (as shown in FIG. 8). In a preferred embodiment as shown in FIG. 9, the reagent vessel 12 with three slots 121 comprises two protruding portions 126 and one protruding portion 127. The first and second protruding portions 126 are arranged on one side surface of the reagent vessel 12 at the positions of first and third slots 121, and the protruding portion 127 is arranged on one side surface of the third slot 121. The side surface with the first and second protruding portions 126 is adjacent to the side surface with the protruding portion 127. There are five groove portions 104, arranged on the frame 101 and/or separator(s) 102 of the support rack 10 and corresponding to the protruding portions 126 and 127 in terms of position. No specific numbers, shapes or positions are required for the third fastener on the reagent vessel 12 and the fourth fastener on the support rack 10, provided that the reagent vessel 12 can be fastened to the support rack 10. The arrangement thereof may be adjusted depending on actual needs.

In one example of the present invention, 6-slot reagent vessels 12 (each with six slots 121) according to the first embodiment and 3-slot reagent vessels 12 (each with three slots 121) according to the third embodiment can be used together to obtain different combinations of reagent vessels 12 with various numbers of slots. For example, if one 6-slot reagent vessel 12 (with six slots 121) and one 3-slot reagent vessel 12 (with three slots 121) are used together, the assembled reagent vessel kit will include reagent vessels with a total of nine slots.

Though it is not illustrated in the drawings, in one example of the present invention, the number of separators 102 in the support rack 10 and the number of slots 121 in the reagent vessel 12 can be adjusted depending on experimental needs. In a preferred embodiment, the support rack 10 includes five separators 102 that partition the area defined by the frame 101 into six strips. In a preferred embodiment, the reagent vessel 12 includes two, four, eight or twelve slots 121. Assembling methods and arrangements of the fasteners can be found in the above descriptions regarding the first to third embodiments. In a preferred embodiment, different reagent vessels 12 with two, four, eight or twelve slots 121 can be used together with one another to obtain different combinations of reagent vessels 12 with various numbers of slots. For example, if two 4-slot reagent vessels 12 (with a total of eight slots 121) and one 2-slot reagent vessel 12 (with two slots 121) are used together, the assembled reagent vessel kit will include reagent vessels with a total of ten slots 121.

The present invention provides different forms of support racks 10 and reagent vessels 12, and thus allows users to select from the various support racks 10 and reagent vessels 12. As a result, reagent vessels 12 with various numbers of slots 121 can be obtained and inserted into the reagent plate 1. Therefore, by allowing users to adjust the number of reagent vessels in a reagent plate flexibly, the present invention can be advantageous in reducing the waste of experimental consumables such as reagent vessels.

What is claimed is:

1. A modular reagent plate, comprising:

a support rack comprising a frame and one or more separators, wherein each separator extends between two opposite end surfaces of the frame, and two ends of each separator are respectively connected to the two opposite end surfaces of the frame, and wherein the support rack includes a plurality of first slots, and each of the plurality of first slots being defined by at least the two opposite end surfaces of the frame and at least one of the separators;

a reagent vessel with a plurality of second slots formed as one piece; and a base comprising a frame body, wherein the support rack is disposed on the frame body of the base and can be detachably combined with the base, wherein the reagent vessel further comprises at least two first fasteners positioned on at least one side surface thereof, the support rack further comprises at least two second fasteners, at least one of said at least two second fasteners is positioned on the one or more separators of the support rack, and the at least two first fasteners and the at least two second fasteners correspond to each other and can be joined together, wherein the at least two first fasteners are positioned at an upper part of the at least one side surface of the reagent vessel, and wherein a length of at least one of the plurality of first slots is greater than a length of the reagent vessel, and the first and second fasteners are configured to secure the reagent vessel in said at least one of the plurality of first slots without engaging an entire periphery of the reagent vessel.

2. The modular reagent plate of claim 1, wherein the support rack further comprises a third fastener positioned on at least one edge of the frame, the frame body of the base comprises a fourth fastener positioned on at least one side wall of the frame body, and the third fastener and the fourth fastener correspond to each other and can be joined together.

3. The modular reagent plate of claim 2, wherein the third fastener includes a bump, and the fourth fastener includes a receiving portion.

4. The modular reagent plate of claim 1, wherein the one or more separators is arranged horizontally and/or vertically.

5. The modular reagent plate of claim 1, further comprising a heat plate.

6. The modular reagent plate according to claim 1, wherein said at least two first fasteners are respectively positioned on two different and adjacent side surfaces of the reagent vessel, and one of said at least two second fasteners, other than said at least one of said at least two second fasteners positioned on the one or more separators, is positioned on the frame.

7. A reagent vessel kit, comprising:

a modular reagent plate according to claim 1, and a heat plate to heat the reagent vessel, wherein the reagent vessel is disposed in a first slot defined by the one or more separators of the support rack.

8. The reagent vessel kit of claim 7, wherein each of the at least two first fasteners includes a protruding portion, and each of the at least two second fasteners includes a groove portion.

9. The reagent vessel kit of claim 7, wherein the plurality of second slots include 2, 3, 4, 6, 8 or 12 slots.

* * * * *